US006082930A

United States Patent [19]

Miya et al.

[11] Patent Number: 6,082,930

[45] Date of Patent: Jul. 4, 2000

[54] SHIELD DRIVING MACHINE

[75] Inventors: Kiyoshi Miya; Yoshihiro Tanaka, both of Tokyo, Japan

[73] Assignee: Obayashi Corporation, Osaka, Japan

[21] Appl. No.: 09/184,985

[22] Filed: Nov. 3, 1998

[30] Foreign Application Priority Data

Nov. 27, 1997 [JP] Japan ..... 9-326522
Nov. 27, 1997 [JP] Japan ..... 9-326526

[51] Int. Cl.[7] ..... E03F 3/06

[52] U.S. Cl. ..... 405/146; 299/56; 299/58; 405/138; 405/141

[58] Field of Search ..... 405/141, 138, 405/155, 154, 157, 146; 299/56, 58, 64

[56] References Cited

U.S. PATENT DOCUMENTS 3,979,917 9/1976 Crafton ..... 405/138
4,534,676 8/1985 Saito ..... 405/141 X
4,571,122 2/1986 Yamamoto et al. ..... 299/58 X
5,032,039 7/1991 Hagimoto et al. ..... 405/141
5,078,545 1/1992 Akasaka ..... 405/142

*Primary Examiner*—Dennis L. Taylor
*Attorney, Agent, or Firm*—Nioxn Peabody LLP; Thomas W. Cole

[57] ABSTRACT

The present invention relates to a shield driving machine by which eliminates excessive work of the ground when working at a curved section while suppressing an increase of the sinking of the ground surface and securing a quickening in the stability of segments. In the shield driving machine, a bulkhead 16 is provided at the tip end side of the shield driving machine body 14 of the shield driving machine 10. The chamber 18 which is formed by the bulkhead 16 and has the tip end side open is filled up with excavated earth and sand and is used to oppose the earth pressure and water pressure in the natural ground. A rotating shaft 22 which supports cross-shaped spokes 20 penetrates on the center axis of the bulkhead 16. At the shield driving machine 10, a plurality of openings 24 which discharge a part of the excavated earth and sand supplied from the chamber 18 to the rear side of the shield driving machine body 14 are provided at the hood portion 27.

8 Claims, 4 Drawing Sheets

SHIELD DRIVING MACHINE

DETAILED DESCRIPTION OF THE INVENTION

1. Field of the invention

The present invention relates to a shield driving machine.

2. Prior arts

In order to secure drinking water on islands where it scarcely rains or in desert areas, a plant producing fresh water is installed in the vicinity of a sea shore. Furthermore, sea water is prime water for treatment in salt production plants, wherein in these types of sea water treatment facilities, it is necessary to introduce sea water into a plant producing fresh water.

Therefore, in such a sea water treatment facility, conventionally, sea water was introduced through a water-intake tunnel in which a vinyl chloride tube covered with unwoven cloth, having a number of penetrated water-intake pores formed thereon, and in which porous Hume pipes were laid.

However, since a water-intake tunnel of such construction is buried by an excavation construction method or a sinking and laying method, the site on the ground right above the laying position and/or its surrounding are exclusively occupied for the sinking and laying work. Therefore, from this viewpoint, there are various limitations in the construction work resulting therefrom.

Therefore, the inventors developed a technique for building these types of water-intake tunnels by a shield driving method and proposed it in Japanese Patent Application No. 218492 of 1997. Segments used to build such water-intake tunnels are, as shown in FIGS. 8 and 9, such that a permeable member 2 is attached to the outside of a body plate 1 such as steel segments and ductile segments conventionally used for a usual shield construction method.

A permeable member 2 is made of porous concrete, etc., and is constructed so that underground water passing through the permeable member 2 is positively taken into the inside through water-intake pores (not illustrated) which are secured at the body plate 1.

However, when building a water-intake tunnel by such a shield driving machine, using such water-intake segments 3, particularly, there were such technical problems as described below.

That is, in the usual shield driving method, a back-filling material is supplied into the tail void produced by a difference between the shield driving machine body 4 and the outer diameter of segments, whereby a sinking of the ground surface was suppressed, and a quickening in the stability of the segments was secured.

However, if a hardening grout material is supplied as a back-filling material in the building of a water-intake tunnel, as shown in FIG. 9, a non-permeable layer 5 is produced around the permeable members 2 on the outer surface of the water-intake segments 3, and peripheral water becomes unable to be taken in from the water-intake segments 3. Therefore, the back-filling can not be carried out.

Unless the back filling can be carried out, the sinking of the ground surface right above the shield driving machine or on the segments is increased, and it will become difficult to secure a quickening in the stability of the segments.

Furthermore, in excavating a curved section, not only when building the abovementioned water-intake tunnel but also when building a general tunnel, the side portions around the shield driving machine are extra-excavated for preparation, the passing position of the shield driving machine is made brittle, wherein a friction between the shield driving machine and the natural ground is reduced. However, in a case where no ground improvement is performed in a loose sand layer, since there was such a problem, by which the extra-excavated portions are caused to collapse, the friction between the shield driving machine and the natural ground can not be sufficiently reduced at the curved section.

The present invention was developed in view of these problems, and it is therefore an object of the invention to provide a shield driving machine which is able to improve the ground at curved sections while suppressing an increase of the sinking of the ground surface and quickening the stability of segments.

SUMMARY OF THE INVENTION

In order to achieve the abovementioned objects, a shield driving machine provided with a chamber in which excavated earth and sand are filled, at the tip end of the shield driving machine body is characterized in that an opening is provided, which discharges a part of the abovementioned excavated earth and sand from the abovementioned chamber to the rear side of the abovementioned shield driving machine body in line with intake of the abovementioned earth and sand.

According to the shield driving machine constructed as described above, since it is provided with an opening which discharges a part of excavated earth and sand from the chamber to the rear side of the shield driving machine body, the excavated earth and sand discharged through the opening are gradually pushed backward along the sides of the shield driving machine, thereby causing the tail void, produced by a difference between the shield driving machine and the segments, to be filled therewith.

Therefore, it is possible to suppress an increase of the sinking of the ground surface right above the shield driving machine and segments without forming any non-permeable portion at the outer circumference of the water-intake segments, and it is possible to secure a quickening in the stability of the segments.

Since the extra-excavated portions are filled up with the excavated earth and sand discharged from the opening when working at a curved section, it is possible to prevent the natural ground of the extra-excavated portions from collapsing, and concurrently, since the excavated earth and sand are excavated by a shield driving machine, they are made brittle, wherein the friction with the natural ground is made small.

The abovementioned opening can be opened and closed by a movable plate which slidingly moves along the inner circumferential surface of the abovementioned shield driving machine body, and can be opened and closed by a movable plate which slidingly moves along the axial direction of the abovementioned shield driving machine body.

With the construction, since the discharge of excavated earth and sand from the opening can be adjusted by the movable plate, for example, in the building of a water-intake tunnel, shield construction work which is the same as before can be carried out in a range where supplying of a back-filling material is performed.

Furthermore, a shield driving machine according to the invention can be preferably applied to the building of water-intake tunnels.

Furthermore, the invention is characterized in that, in a shield driving machine body provided with a chamber in which excavated earth and sand are filled, at the tip end of the shield driving machine, a discharge passage is provided, which discharges a part of the abovementioned excavated earth and sand from the abovementioned chamber to the rear side of the abovementioned shield driving machine body in line with intake of the abovementioned earth and sand.

According to the shield drilling machine constructed as described above, since a discharge passage is provided which discharges a part of excavated earth and sand from the chamber to the rear side of the shield driving machine body in line with intake of the excavated earth and sand, the excavated earth and sand discharge from the discharge passage is gradually pushed backward along the sides of the shield driving machine and are filled in the tail void produced by a difference between the shield driving machine and the outer diameter of segments.

Therefore, it is possible to suppress an increase of the sinking of the ground surface right above the shield driving machine and segments without forming any non-permeable portion at the outer circumference of the water-intake segments, and it is possible to secure a quickening in the stability of the segments.

Since the extra-excavated portions are filled up with the excavated earth and sand discharged from the discharge passage when working at a curved section, it is possible to prevent the natural ground of the extra-excavated portions from collapsing, and concurrently, since the excavated earth and sand are excavated by a shield driving machine, they are made brittle, wherein the friction with the natural ground is made small.

The abovementioned discharge passage has one end thereof opened to the bulkhead which forms the abovementioned chamber, and has the other end thereof open to the side of the abovementioned shield driving machine body, and is provided with an opening and closing cover which adjusts the opening and closing of the corresponding discharge passage.

According to the construction, since it is possible to adjust the discharge of the excavated earth and sand from a discharge passage by using the opening and closing cover, for example, in the building of a water-intake tunnel, shield construction work which is the same as before can be carried out in a range where supplying of a back-filling material is performed.

Furthermore, a shield driving machine according to the invention can be preferably applied to the building of water-intake tunnels.

As described in detail with respect to the preferred embodiments, according to the shield driving machine of the invention, it is possible to secure a quickening in the stability of segments while suppressing the sinking of the ground surface, and to improve the ground foundation in working at a curved section.

DETAILED DESCRIPTION OF EMBODIMENTS OF THE INVENTIONS

Figure 1:
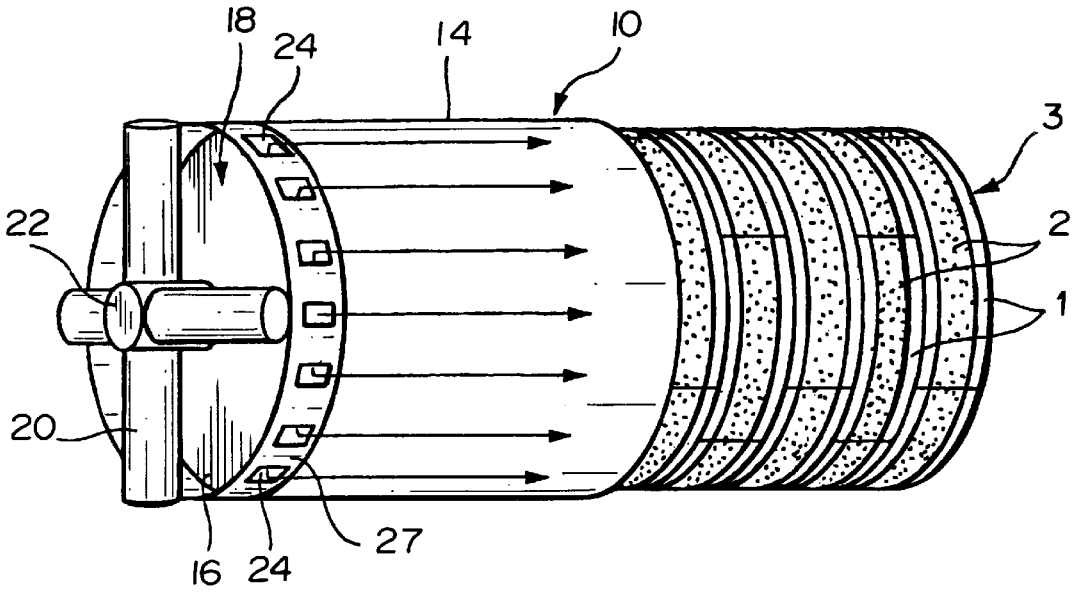
FIG. 1 is an external view showing the first preferred embodiment of a shield driving machine according to the invention.

Hereinafter, a detailed description is given of preferred embodiments of the invention with reference to the accompanying drawings. FIG. 1 shows a first preferred embodiment of a shield driving machine according to the invention.

Figure 8:
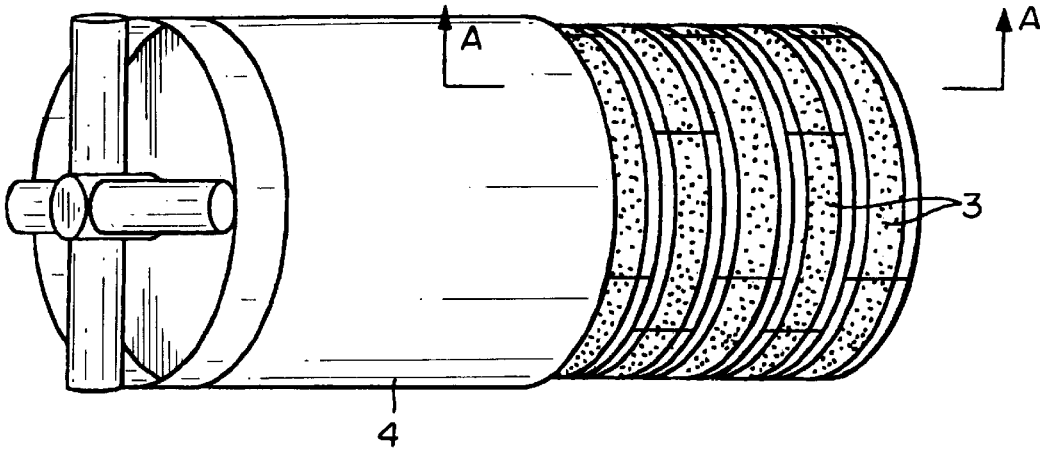
FIG. 8 is an external view when building a water-intake tunnel by a conventional shield driving machine.
Figure 9:
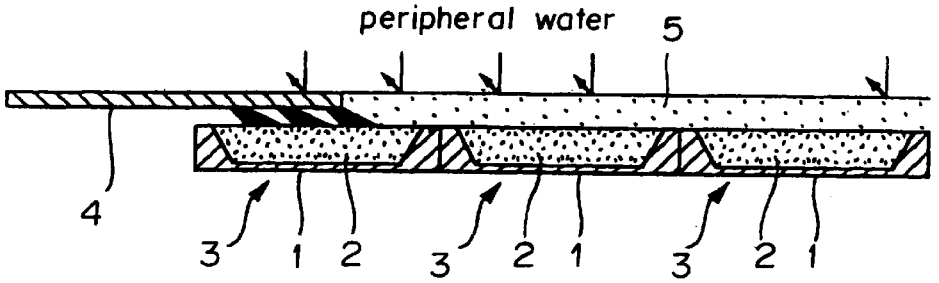
FIG. 9 is a sectional view taken along the line A—A in FIG. 6.

A shield driving machine 10 illustrated in the same drawing is applied in a case of building a water-intake tunnel. The water-intake tunnel is built by cylindrically assembling water-intake segments 3 illustrated in FIG. 8 and FIG. 9.

The water-intake segments 3 are such that a permeable member 2 is attached to the outside of a body plate 1 such as steel segments and ductile segments used for a usual shield driving method, and they are formed integral with each other.

The permeable member 2 is made of porous concrete, etc., and is constructed so that underground water passing through the permeable member 2 is positively taken in the interior through water-intake ports secured at the body plate 1.

Furthermore, the shield driving machine 10 illustrated in the same drawing is of an earth pressure type, a bulkhead 16 is provided at the tip end side of the shield driving machine body 14 which is cylindrically formed. The chamber 18 which is open at its tip end side and is sectioned by the bulkhead 16 is filled up with the excavated earth and sand and is used to oppose the earth pressure and water pressure of the natural ground. A rotating shaft 22 which supports cross-shaped spokes 20 is rotatably supported on the center axis of the bulkhead 16 in a state where the rotating shaft penetrates the chamber 18.

Bits (not illustrated) are secured and fixed on the spokes 20, wherein earth and sand are excavated by the bits secured on the spokes 20 by driving and rotating the rotating shaft 22, and the earth and sand are taken into the chamber 18.

Air foams can be used as an additive in the excavated earth and sand taken into the chamber 18, and they are mixed with the earth and sand. Thereby, the fluidity thereof is increased. After air foams are eliminated, the earth quality of the excavated earth and sand become the same as that of the natural ground, wherein the permeability is restored to the original state.

Although the basic construction of an earth pressure type shield driving machine constructed as described above is the same as that of conventional types of machines, there are remarkable differences, which are described below, in a shield driving machine 10 according to the preferred embodiment.

That is, in the shield driving machine 10 according to the preferred embodiment, a plurality of openings 24 which discharge a part of the excavated earth and sand from to the rear part side of the shield driving machine body 14 in line with the intake of the excavated earth and sand, are provided at the hood portion 27 of the shield driving machine body 14.

The respective openings 24 are formed by drilling the tip end side of the shield driving machine body 14, which forms the side surface of the chamber 18, in a square-shaped state. A plurality of openings 24 are provided in the circumferential direction of the shield driving machine body 14.

According to the shield driving machine 10 constructed as described above, as the chamber 18 is filled up in line with the intake of the excavated earth and sand, a part of the excavated earth and sand passes through the openings 24 since they are provided, and is discharged to the side of the shield driving machine body 14.

The excavated earth and sand discharged to the sides of the shield driving machine body 14 are pushed by the freshly excavated earth and sand discharged by the shield driving machine in line with the excavation and are gradually pushed backward along the side of the shield driving machine body 14. Thereby, the tail void produced by a difference between the shield driving machine 10 and the outer diameter of segments 3 is caused to be filled up therewith.

Therefore, it is possible to suppress an increase of the sinking of the ground surface right above the shield driving machine 10 and segments 3 without forming any non-permeable layer around the outer circumference of the water-intake segments 3, and concurrently, it is possible to secure a quickening in the stability of segments.

Figure 2:
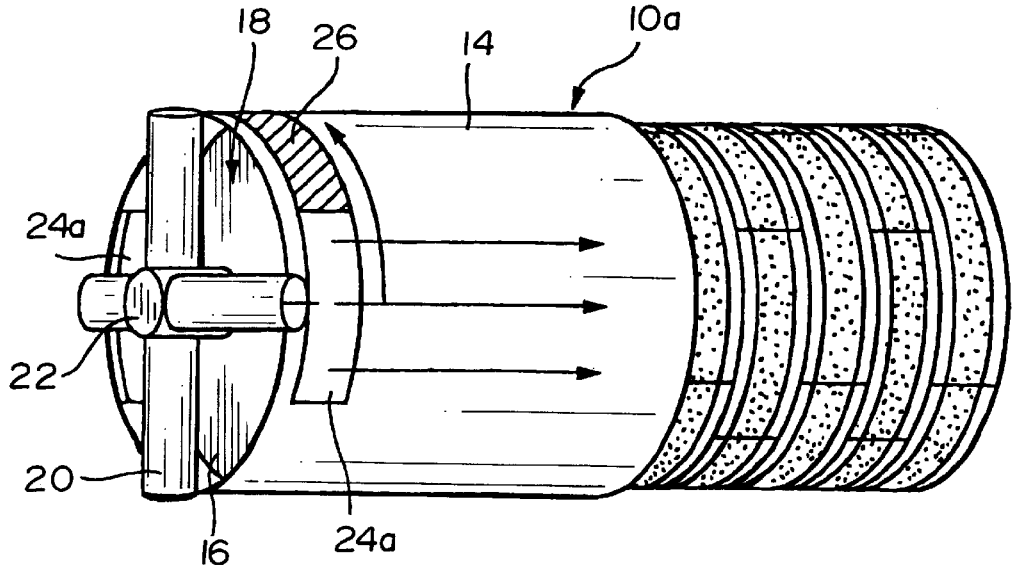
FIG. 2 is an external view showing the second preferred embodiment of a shield driving machine according to the invention.
Figure 3:
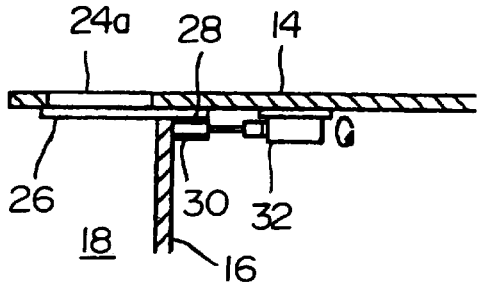
FIG. 3 is a sectional view showing major parts in FIG. 2.

Furthermore, since the extra-excavated portions are filled up with the excavated earth and sand discharged from the opening 24 when excavating at the curved sections, it is possible to prevent the natural ground of the extra-excavated portions from collapsing, and since the excavated earth and sand are made brittle because they are excavated by the shield driving machine 10, the friction with the natural ground is decreased. FIG. 2 and FIG. 3 show a second preferred embodiment of a shield driving machine according to the invention, wherein parts which are the same as or similar to those of the abovementioned preferred embodiment are given the same reference numbers, and the description thereof is omitted. Hereinafter, only the features thereof are described. The shield driving machine 10*a* illustrated in these drawings is provided with an opening 24*a* which discharges a part of the excavated earth and sand supplied from the chamber 18 to the rear side of the shield driving machine body 14 in line with intake of the excavated earth and sand as in the first preferred embodiment. Although the opening 24*a* according to this preferred embodiment is formed by drilling the tip end side of the shield driving machine body 14, which forms a side of the chamber 18, like a square, the opening area thereof is made greater than those in the first preferred embodiment.

Furthermore, as regards the opening 24*a* illustrated in FIG. 2, although only one side of the shield driving machine body 14 is shown, another opening having the same construction is provided on the rear side of this side.

The opening 24*a* is caused to be opened and closed by a movable plate 26 which slidingly moves along the circumferential direction of the shield driving machine body 14. The movable plate 26 is curved to the same curvature as that of the shield driving machine body 14, one end side of which is disposed so as to invade the bulkhead 16.

A rack gear 28 is attached to the edge inside the bulkhead 16 of the movable plate 26. A pinion 30 is engaged with the rack gear 28, wherein a motor 32 is connected to the pinion 30.

At the opening 24*a* thus constructed, the movable plate 26 is slidingly moved in the circumferential direction by driving the motor 32, and the opening degree of the opening 24*a* can be adjusted, in addition to the action and effects in the first preferred embodiment.

Therefore, adjustment of the discharge quantity of the excavated earth and sand through the opening 24*a* is enabled, for example, in a range where supplying of a back-filling material is enabled in water-intake tunnel construction, if the opening 24*a* is completely clogged by the movable plate 26, usual shield driving work can be carried out.

Figure 4:
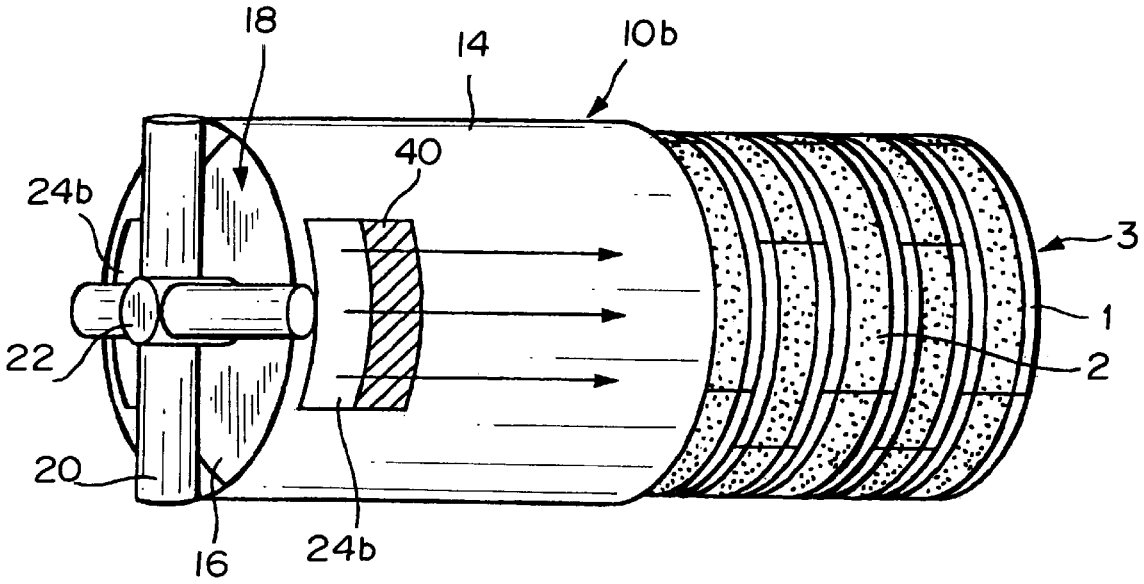
FIG. 4 is an external view showing the third preferred embodiment of a shield driving machine according to the invention.
Figure 5:
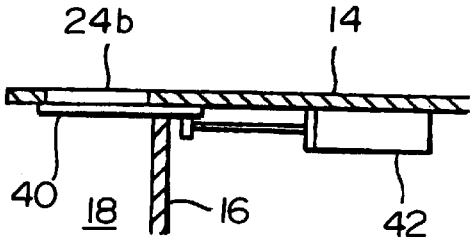
FIG. 5 is a sectional view showing major parts in FIG. 4.

FIG. 4 and FIG. 5 show a third preferred embodiment of a shield driving machine according to the invention, wherein parts which are the same as or similar to those in the abovementioned preferred embodiments are given the same reference numbers, and the description thereof is omitted. Only the features thereof are described below.

The shield driving machine 10*b* illustrated in these drawings is provided with a plurality of openings 24*b* which discharge a part of the excavated earth and sand supplied from the chamber 18 backward of the shield driving machine body 14 in line with intake of the excavated earth and sand as in the second preferred embodiment.

The opening 24*b* according to the preferred embodiment is formed by drilling the tip end side of the shield driving machine body 14, which forms the chamber 18, like a square. As regards the openings 24*b* illustrated in FIG. 4, only one side of the shield driving machine body 14 is illustrated. However, openings having the same construction are also secured on the rear side of this side.

The opening 24*b* is caused to be opened and closed by a movable plate 40 which slidingly moves along the axial direction of the shield driving machine body 14. The movable plate 40 is curved to the same curvature as that of the shield driving machine body 14, wherein one end side thereof is disposed so as to invade the bulkhead 16.

A flexible plunger of a jack 42 is connected to the end edge in the bulkhead 16 of the movable plate 40.

At the openings 40 thus constructed, the movable plate 40 is slidingly moved in the axial direction by driving the jack 42, wherein the opening degree thereof can be adjusted. Therefore, the action and effects which are equivalent to those in the abovementioned second preferred embodiment can be obtained.

Figure 6:
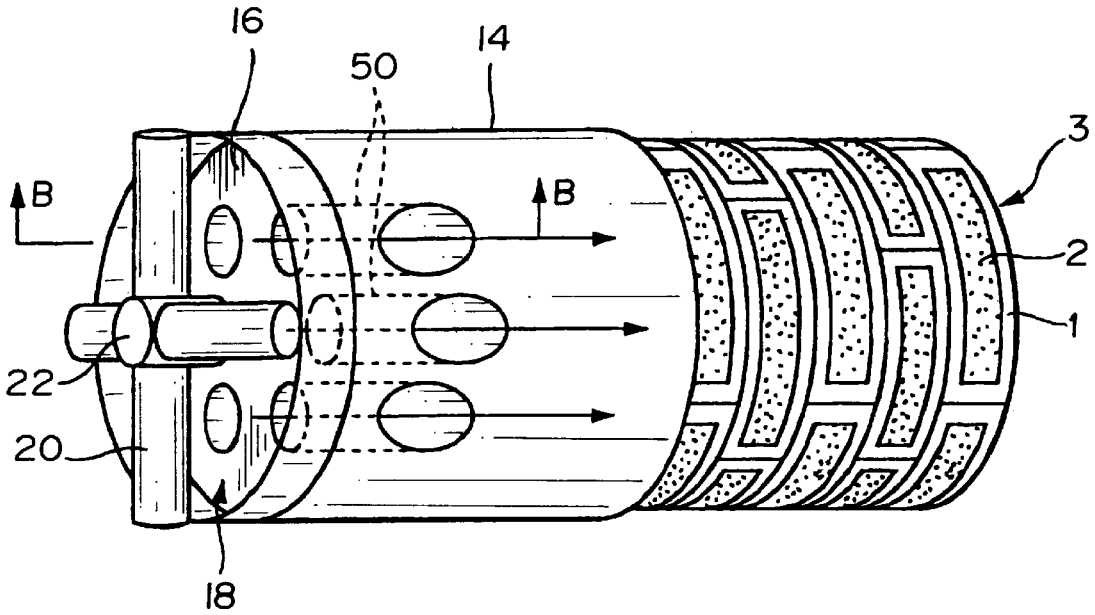
FIG. 6 is an external view showing the fourth preferred embodiment of a shield driving machine according to the invention.
Figure 7:
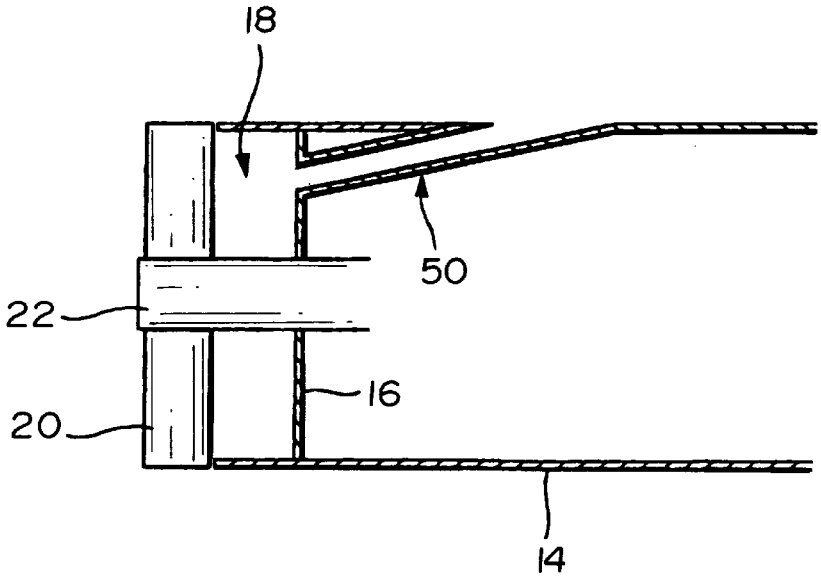
FIG. 7 is a sectional view with the line B—B in FIG. 6 turned by an appointed degree of angle.

FIG. 6 and FIG. 7 show a fourth preferred embodiment of a shield driving machine according to the invention, wherein parts which are the same as or similar to those in the abovementioned preferred embodiments are given the same reference numbers, and the description thereof is omitted. Only the features thereof are described below.

The shield driving machine 10 illustrated in the drawings is applied in a case where a water-intake tunnel is built. The water-intake tunnel is built by cylindrically assembling water-intake segments 3 illustrated in FIG. 8 and FIG. 9 as in the abovementioned preferred embodiments.

Furthermore, the shield driving machine illustrated in the drawings is of an earth pressure type as in the abovementioned embodiments, wherein a bulkhead 16 is provided at the tip end side of the cylindrically formed shield driving machine body 14.

Furthermore, although the basic construction of the earth pressure shield driving machine is the same as that of conventional types of machines, the shield driving machine 10 according to the preferred embodiment has remarkable differences as the points described below show;

That is, the shield driving machine 10 according to the preferred embodiment is provided with a plurality of discharge passages 50 which discharge a part of excavated earth and sand supplied from the chamber 18 to the rear part of the shield driving machine body 14 in line with intake of the excavated earth and sand.

Each of the discharge passages 50 has one end thereof open to the bulkhead 16 which forms the chamber 18 and has the other end thereof open to the side of the rear part side of the shield driving machine body 14. The discharge passages 50 illustrated in FIG. 6 are composed of, for example, a metal-made pipe, and in the same drawing, one side of the shield driving machine body 14 is illustrated. Similar passage discharges 50 are also provided on the rear side of this side.

Furthermore, in FIG. 6, the discharge passages 50 are illustrated in a case where they are provided in three rows in parallel to each other on the side of the shield driving machine body 14. However, it is needless to say that the discharge passage 50 may be provided on the upper part or the lower part of the shield driving machine body 14.

According to the shield driving machine 10 thus constructed, since the discharge passages 50, which discharge excavated earth and sand to the rear side of the shield driving machine body 14, are provided if the chamber 18 is filled up with excavated earth and sand in line with intake of the excavated earth and sand, a part of the excavated earth and sand is discharged to the sides of the shield driving machine body 14 through the discharge passages 50.

the excavated earth and sand discharged to the side of the shield driving machine body 14 are pushed by the freshly excavated earth and sand gradually discharged in line with the excavation of the shield driving machine 10 and are gradually pushed backward along the side of the shield driving machine body 14, thereby causing the tail void produced by a difference between the shield driving machine 10 and the outer diameter of segments 3 to be filled up therewith.

Therefore, it is possible to suppress an increase of the sinking of the ground surface right above the shield driving machine 10 and segments 3 without forming any non-permeable layer on the outer circumference of the water-intake segments 3, and it is possible to secure a quickening in the stability of the segments.

Furthermore, since the extra-excavated portions are filled up with the excavated earth and sand discharged from the discharge passages 50 when working at a curved section, it is possible to prevent the natural ground of the extra-excavated portions from collapsing, and since the excavated earth and sand are made brittle because they are excavated by the shield driving machine 10, the friction with the natural ground is reduced. Furthermore, at the discharge passages 50 of the shield driving machine 10 illustrated in the abovementioned embodiments, for example, an opening and closing cover of a slide type, etc., may be secured at portions open to the bulkhead 16, which adjusts the opening and closing of the discharge passages 24.

If such a cover is provided, since the discharge of the excavated earth and sand from the discharge passages 50 can be adjusted as necessary, for example, in a range where supplying of a back-filling material is enabled when building a water-intake tunnel, a shield driving method which is similar to conventional methods can be employed.

Furthermore, although the abovementioned preferred embodiment is described in a case where the shield driving machine according to the invention is applied to the building of a water-intake tunnel, the invention is not limited to the above case, and can be used when building a general tunnel by a shield driving method.

If the invention is applied to a usual shield driving method, in addition to the actions and effects described with regard to the abovementioned preferred embodiments, the ground stress of the tail portion can be released and lowered, and the sinking of the ground can be suppressed by various effects such as improvement in a friction cut effect, lowering of the supplementing quantity of a back-filling material, and improvement in the transmitting effect of the facing pressure when excavating and/or driving, since a part of the excavated earth and sand is discharged to the rear side of the shield driving machine body.

What is claimed is:

1. A shield driving machine comprising:

a shield driving machine body having a tip end including a chamber for receiving earth and sand during an excavation operation;

an opening provided in a wall of said chamber for discharging a part of said excavated earth and sand from said chamber to a rear side of said shield driving machine body in line with intake of said earth and sand, and an adjustment means for adjusting the size of said opening to control a discharge quantity of earth and sand from said opening.

2. A shield driving machine as set forth in claim 1, wherein said adjustment mechanism includes a movable plate which slidingly moves along an inner circumferential surface of said shield driving machine body in a circumferential direction.

3. A shield driving machine as set forth in claim 1, wherein said adjustment mechanism includes a movable plate which slidingly moves along an inner circumferential surface of said shield driving machine body in an axial direction of said shield driving machine body.

4. A shield driving machine as set forth in claim 1, wherein said shield driving machine body has a diameter that is larger than a diameter of water-intake segments disposed behind a rear end of said machine body, and wherein said adjustment means adjusts the size of said opening to fill in a tail void caused by said difference between said diameters of the machine body and water-intake segments.

5. An improved shield driving machine for building a water intake tunnel of the type including a machine body provided with a chamber in which excavated earth and sand are filled, at a tip end of the shield driving machine, wherein a discharge passage is provided in a wall of said chamber which discharges a part of said excavated earth and sand from said chamber to the rear side of said shield driving machine body in line with intake of said earth and sand, wherein the improvement comprises:

an adjustment means for adjusting the size of said opening to control a discharge quantity of earth and sand from said opening to fill in a tail void caused by a difference in a diameter of said machine body and water-intake segments disposed behind said machine body.

6. A shield driving machine as set forth in claim 5, wherein in said discharge passage has one end thereof open to a bulkhead which forms said chamber, and the other end thereof open to the side of said shield driving machine, and an opening and closing cover is provided, which adjusts the opening and closing of said discharge passage.

7. A shield driving machine as set forth in claim 5, wherein said adjustment means includes a gear train for moving said cover.

8. A shield driving machine as set forth in claim 6, wherein said adjustment means includes a hydraulic cylinder for moving said cover.

* * * * *